US008422908B2

(12) United States Patent
Lee et al.

(10) Patent No.: US 8,422,908 B2
(45) Date of Patent: Apr. 16, 2013

(54) DEVELOPING DEVICE AND IMAGE FORMING APPARATUS INCLUDING THE SAME

(75) Inventors: Sang-hoon Lee, Suwon-si (KR); Dae-seob Kweon, Suwon-si (KR); Jong-in Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 159 days.

(21) Appl. No.: 12/872,075

(22) Filed: Aug. 31, 2010

(65) Prior Publication Data

US 2011/0176828 A1 Jul. 21, 2011

(30) Foreign Application Priority Data

Jan. 21, 2010 (KR) ..... 10-2010-0005758

(51) Int. Cl.
*G03G 15/08* (2006.01)

(52) U.S. Cl.
USPC ..... 399/103; 399/98; 399/102; 399/105; 399/106; 399/111; 399/119

(58) Field of Classification Search ..... 399/98, 399/102, 103, 105, 106, 111, 119
See application file for complete search history.

(56) References Cited

U.S. PATENT DOCUMENTS

| | | | | |
|---|---|---|---|---|
| 4,930,684 | A * | 6/1990 | Patterson | 399/262 |
| 2003/0161644 | A1* | 8/2003 | Yokoi et al. | 399/102 |
| 2004/0114959 | A1 | 6/2004 | Daniels | |
| 2004/0258441 | A1 | 12/2004 | Park et al. | |
| 2008/0226367 | A1 | 9/2008 | Kim et al. | |
| 2008/0253803 | A1* | 10/2008 | Nittani et al. | 399/114 |
| 2009/0087214 | A1 | 4/2009 | Utsunomiya et al. | |
| 2009/0214254 | A1 | 8/2009 | Jeon | |
| 2009/0222664 | A1 | 9/2009 | Cho et al. | |

FOREIGN PATENT DOCUMENTS

| | | |
|---|---|---|
| JP | 9106162 | 4/1997 |
| JP | 10301460 | 11/1998 |
| JP | 11002947 | 1/1999 |
| JP | 2002341648 | 11/2002 |
| KR | 1020040110339 | 12/2004 |
| KR | 1020060081453 | 7/2006 |
| KR | 1020070097994 | 10/2007 |

OTHER PUBLICATIONS

Korean Office Action issued Aug. 26, 2011 in KR Application No. 10-2010-0070473.
Extended European Search Report issued May 24, 2011 in EP Application No. 10175135.2.
Partial European Search Report issued May 20, 2011 in EP Application No. 10175192.3.
Extended European Search Report issued Aug. 4, 2011 in EP Application No. 10175192.3.
Korean Notice of Allowance Issued on Sep. 27, 2012 in KR Patent Application No. 10-2011-0109436.

* cited by examiner

*Primary Examiner* — Ryan Walsh
(74) *Attorney, Agent, or Firm* — Stanzione & Kim, LLP

(57) ABSTRACT

A developing device includes a toner storage area containing toner, a developing portion in which a developing roller is installed, and a housing including a toner supply window to connect the toner storage area and the developing portion. A pair of rails is disposed on the toner supply window to extend in a lengthwise direction of the developing roller, and a blocking member including a blocking portion is provided to open and close the toner supply window when the blocking member is removed from and inserted into the pair of rails from outside of the housing, respectively.

42 Claims, 9 Drawing Sheets

DEVELOPING DEVICE AND IMAGE FORMING APPARATUS INCLUDING THE SAME

CROSS-REFERENCE TO RELATED APPLICATIONS

This application claims the benefit of Korean Patent Application No. 10-2010-0005758, filed on Jan. 21, 2010, in the Korean Intellectual Property Office, the disclosure of which is incorporated herein in its entirety by reference.

BACKGROUND

1. Field of the Invention

The present general inventive concept relates to a developing device and an electrophotographic image forming apparatus including the developing device.

2. Description of the Related Art

An electrophotographic image forming apparatus prints images on a recording medium through several processes, which may include irradiating light modulated according to image information onto a photoconductor to form an electrostatic latent image on the surface of the photoconductor, supplying toner to the electrostatic latent image to develop the electrostatic latent image into a visible toner image, and transferring and fixing the toner image onto the recording medium. The electrophotographic image forming apparatus includes a developing device which contains toner.

The photoconductor and the toner may be provided in the form of a replaceable cartridge that is commonly referred to as a 'developing device'. When the toner in the developing device is exhausted, the developing device may be removed from the electrophotographic image forming apparatus and replaced with a new developing device.

SUMMARY

A toner storage area and a developing portion need to be separated from each other so that toner in a developing device does not leak before the developing device is installed in an electrophotographic image forming apparatus.

The present general inventive concept provides a developing device in which the toner storage area and the developing portion are easily separated from each other and an electrophotographic image forming apparatus including the developing device.

According to an aspect of the present general inventive concept, there is provided a developing device that is attached to or detached from a main body of an electrophotographic image forming apparatus, the developing device including a toner storage area containing toner, a developing portion in which a developing roller is installed, and a housing including a toner supply window for connecting the toner storage area and the developing portion, a pair of rails disposed on the toner supply window and extending in a lengthwise direction of the developing roller, and a blocking member including a blocking portion to open and close the toner supply window when the blocking member is inserted in the pair of rails from an outside of the housing or is removed from the pair of rails via an insertion hole formed in sidewalls of the housing to be aligned with the pair of rails.

The blocking member may further include a bent portion extending from the blocking portion and disposed at outside of the housing when the blocking portion is inserted in the rails.

The bent portion may be bent in a direction parallel to the sidewalls of the housing. The developing device may further include a communication portion disposed on the sidewalls of the housing and electrically connected to the main body when the developing device is mounted on the main body, wherein the blocking portion covers the communication portion when the blocking portion is inserted in the rails. The developing device may further include a securing portion disposed on the sidewalls of the housing and securing the bent portion when the bent portion covers the communication portion.

The bent portion may be divided from the blocking portion along a bending line and may be bend able in the direction parallel to the sidewalls of the housing. The developing device may further include a communication portion disposed on the sidewalls of the housing and electrically connected to the main body when the developing device is mounted on the main body, wherein the bent portion is bent parallel to the sidewalls of the housing along the bending line and covers the communication portion when the blocking portion is inserted in the rails. The developing device may further include a securing portion disposed on the sidewalls of the housing and securing the bent portion when the bent portion covers the communication portion.

The developing may further include a sealing member disposed on the sidewalls of the housing and formed of an elastic material to cover the insertion hole.

Features and utilities of the present general inventive concept may also be realized by a developing device that is attached to or detached from a main body of an electrophotographic image forming apparatus, the developing device including a toner storage area containing toner, a developing portion in which a developing roller is installed, and a housing including a toner supply window for connecting the toner storage area and the developing portion, a communication portion disposed on sidewalls of the housing and electrically connected to the main body when the developing device is mounted on the main body, and a blocking member that is removable from the housing and including a blocking portion to close the toner supply window and a protection portion to cover the communication portion.

The blocking portion may be inserted in a position in which the toner supply window is closed, from outside of the housing. The developing device may further include a pair of rails disposed on the toner supply window and extending in a lengthwise direction of the developing roller, an insertion hole in the sidewalls of the housing to be aligned with the pair of rails, wherein the blocking portion closes and opens the toner supply window when the blocking member is inserted in the pair of rails from the outside of the housing or is removed from the pair of rails via the insertion hole, respectively.

The protection portion may be bent in a direction parallel to the sidewalls of the housing from the blocking portion so as to cover the communication portion. The developing device may further include a securing portion disposed on the sidewalls of the housing and securing the bent portion when the protection portion covers the communication portion.

The protection portion may be divided from the blocking portion along a bending line and may be bent in the direction that is parallel to the sidewalls of the housing along the bending line and may cover the communication portion. The developing device may further include a securing portion disposed on the sidewalls of the housing and securing the bent portion when the protection portion covers the communication portion.

The developing device may further include a sealing member disposed on the sidewalls of the housing and formed of an elastic material for covering the insertion hole.

According to another aspect of the present general inventive concept, there may be provided an electrophotographic image forming apparatus including the above-described developing device.

Features and/or utilities of the present general inventive concept may also be realized by a developing device including a housing that defines a toner storage area to store toner, and a developer area including a developing roller to transmit developer, the housing having an opening that defines a window between the toner storage area and the developer area, and a blocking member to be secured to a first securing portion of the housing at a side of the window to close the opening. The blocking member may be inserted into the first securing portion and removed from the first securing portion from outside a sidewall of the housing.

The sidewall may include an opening that defines an insertion hole into which the blocking member is inserted to close the window and from which the blocking member is removed to open the window.

The developing device may further include a sealing member to seal the insertion hole when the blocking member is removed from the insertion hole.

The sealing member may be elastic, such that the sealing member presses against the blocking member when the blocking member is inserted into the insertion hole and seals the insertion hole when the blocking member is removed from the insertion hole.

The sidewall may include a recess adjacent to the insertion hole, and the sealing member may be located within the recess.

At least one side of the sealing member adjacent to the insertion hole may be slanted with respect to a portion of the sealing member in contact with the sidewall.

The first securing portion may include at least one rail that extends in an end-to-end lengthwise direction of the developing roller to guide the blocking member across the opening that defines the window.

The blocking member may include a blocking portion to close the window and a bent portion that is located adjacent to and parallel to the sidewall when the blocking portion is inserted into the first securing portion.

The developing device may further include electrical connections on a surface of the sidewall, the bent portion may cover the electrical connections when the blocking portion is inserted into the first securing portion, and the bent portion may not cover the electrical connections when the blocking portion is removed from the first securing portion.

The sidewall may include at least one second securing portion to secure the bent portion to the sidewall.

The second securing portion may be a tab that extends from the sidewall to cover at least a portion of the bent portion when the blocking portion is inserted into the first securing portion.

The blocking member may include a bending line to bend the blocking member such that the bent portion is at an angle with respect to the blocking portion.

The bending line may be a recess formed in the blocking member.

Features and/or utilities of the present general inventive concept may also be realized by an image forming apparatus that includes a developing unit and an optical scanning unit to scan light onto a photoconductive unit of the developing unit to form an image on the photoconductive unit.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

The present general inventive concept will now be described more fully with reference to the accompanying drawings, in which exemplary embodiments of the present general inventive concept are shown. Like numerals refer to like elements throughout.

Figure 1:
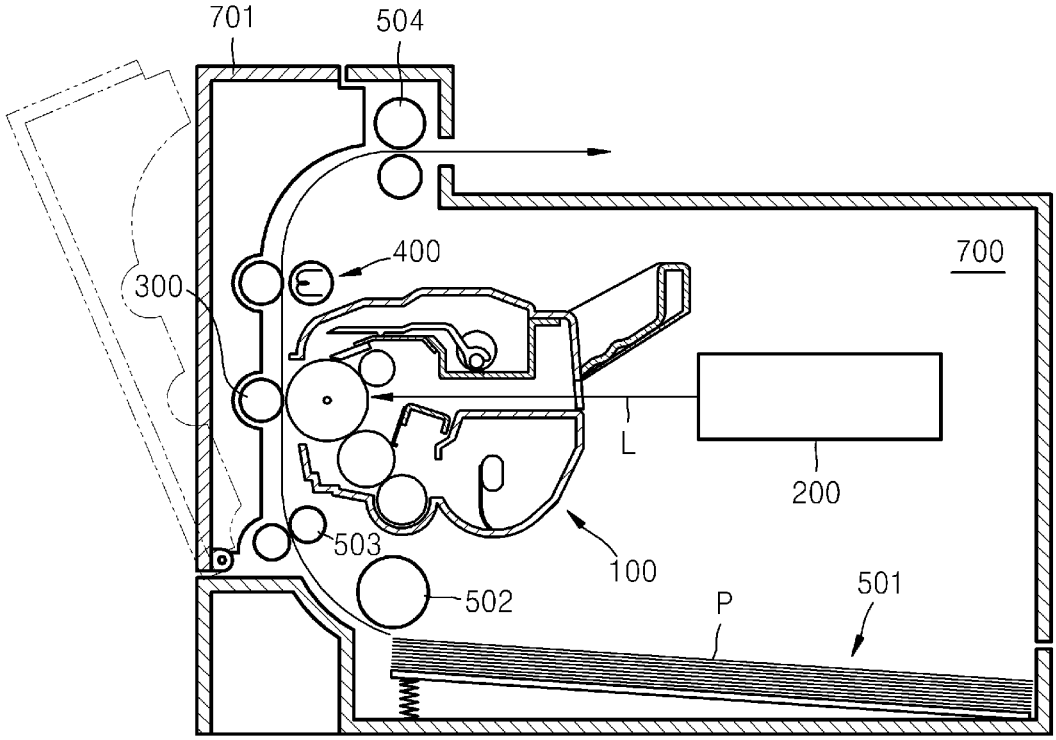
FIG. 1 is a schematic view showing the configuration of an electrophotographic image forming apparatus, according to an embodiment of the present general inventive concept.
Figure 2:
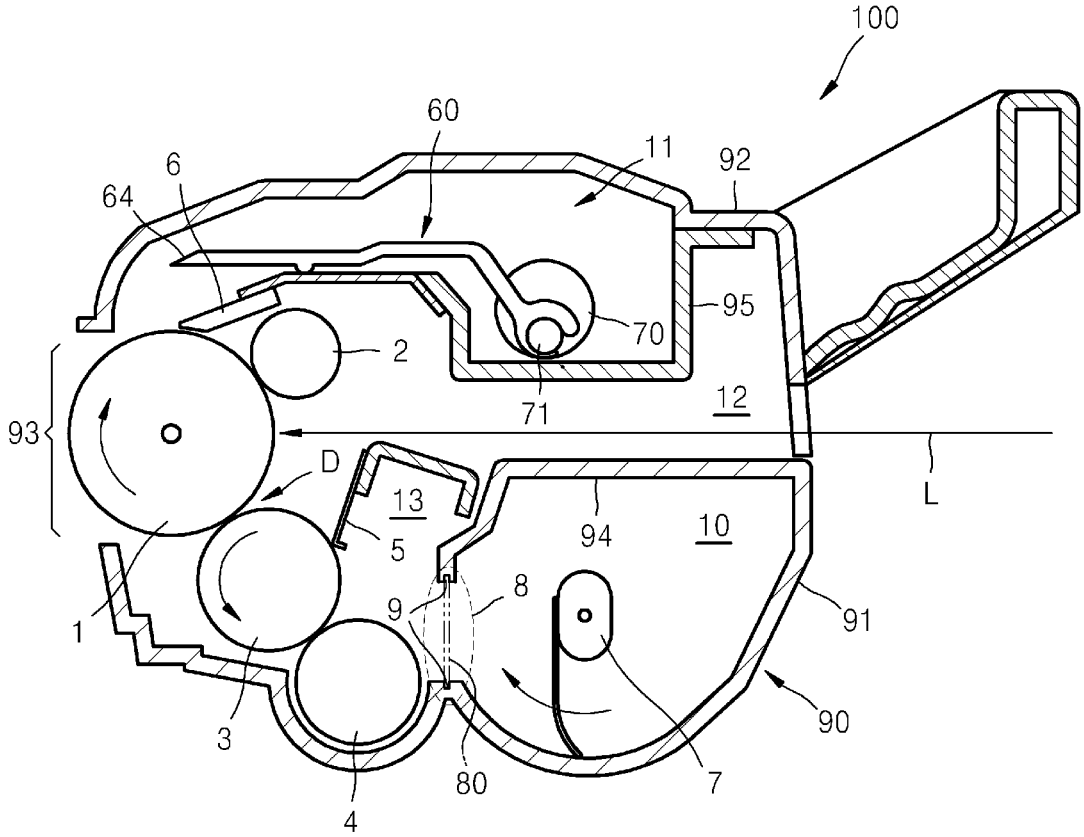
FIG. 2 is a schematic view showing the configuration of a developing device included in the electrophotographic image forming apparatus of FIG. 1, according to an embodiment of the present general inventive concept.

FIG. 1 illustrates a configuration of an electrophotographic image forming apparatus, according to an embodiment of the present general inventive concept, and FIG. 2 is a schematic view showing the configuration of a developing device 100 included in the electrophotographic image forming apparatus of FIG. 1, according to an embodiment of the present general inventive concept. The developing device 100 of according to the present embodiment is an integrated developing device including a photoconductive drum 1 and a developing roller 3.

Referring to FIG. 2, the photoconductive drum 1 is an example of a photoconductor on which an electrostatic latent image is formed, and includes a photoconductive layer formed around an outer circumference of a cylindrical metal pipe. A charging roller 2 is an example of a charger that charges the surface of the photoconductive drum 1 to a uniform potential. A charging bias voltage is applied to the charging roller 2. A corona charger (not shown) may be used instead of the charging roller 2. The developing roller 3 supplies toner to the electrostatic latent image formed on the surface of the photoconductive drum 1 in order to develop the electrostatic latent image. The electrophotographic image forming apparatus according to the present embodiment uses a contact developing technique in which the developing roller 3 and the photoconductive drum 1 contact each other, thereby forming a development nip D. In this case, the developing roller 3 may include an elastic layer (not shown) formed around an outer circumference of a conductive metal core (not shown). When a developing bias voltage is applied to the developing roller 3, the toner is transferred via the development nip D to the electrostatic latent image formed on the surface of the photoconductive drum 1 and attached thereto. When a non-contact developing technique is used, the surface of the developing roller 3 and the surface of the photoconductive drum 1 are separated from each other at intervals of about, for example, several microns.

The developing device 100 may further include a supply roller 4 that attaches the toner to the developing roller 3. A supply bias voltage may be applied to the supply roller 4 so as to attach the toner to the developing roller 3. Reference numeral 5 denotes a regulator that regulates the amount of the toner attached to the surface of the developing roller 3. The regulator 5 may be a regulating blade of which front end contacts the developing roller 3 with a predetermined pressure. Member 6 may be a cleaning blade of which front end contacts the surface of the photoconductive drum 1. Hereinafter, the foreign substance removed from the surface of the photoconductive drum 1 is referred to as waste toner.

The developing device 100 includes a toner container, or toner storage area 10 and a waste toner container or waste toner storage area 11. The waste toner that is removed from the surface of the photoconductive drum 1 is stored in the waste toner storage area 11. The developing device 100 of FIG. 2 is a developing device that uses a one-component developing agent, and the toner is stored in the toner storage area 10. An agitator 7 is installed in the toner storage area 10. The agitator 7 transports the toner to the developing roller 3 and may agitate the toner to frictionally charge it to a predetermined potential. Although one agitator 7 is shown in FIG. 2, the scope of the present general inventive concept is not limited to a single agitator 7. An appropriate number of agitators 7 may be installed in appropriate positions in the toner storage area 10 so as to effectively supply the toner to the developing roller 3 in consideration of the volume or shape of the toner storage area 10. The agitator 7 may include one or a plurality of flexible film-shaped agitation wings formed on a rotation axis. Although not shown, the agitator 7 may be an auger including spiral-shaped agitation wings.

When a two-component developing agent including the toner and a carrier is used as the developing agent, a magnetic carrier and the toner are contained in the toner storage area 10. In this case, the developing roller 3 may include a magnet disposed in a rotating sleeve. The carrier is attached to the outer circumference of the developing roller 3 due to a magnetic force of the magnet, and the toner is attached to the carrier due to an electrostatic force, thereby forming a magnetic brush including the carrier and the toner around the outer circumference of the developing roller 3. Due to the developing bias voltage applied to the developing roller 3, only the toner is moved to the electrostatic latent image formed on the surface of the photoconductive drum 1. The regulator 5 regulates the height of the magnetic brush that is separated from the surface of the developing roller 3 at a predetermined distance and is formed around the outer circumference of the developing roller 3. The agitator 7 transports the carrier and the toner to the developing roller 3 and agitates the carrier and the toner to frictionally charge the toner to a predetermined potential.

A housing 90 of the developing device 100 may include a lower frame 91 and an upper frame 92. Part of the outer circumference of the photoconductive drum 1 is exposed to the outside of the housing 90 via an opening 93. First and second barrier walls 94 and 95 may be disposed in the housing 90. The lower frame 91 and the first barrier wall 94 constitute the toner storage area 10, and the upper frame 92 and the second barrier wall 95 constitutes the waste toner storage area 11. The first barrier wall 94 and the second barrier wall 95 are separated from each other and define an optical path 12 along which light L scanned by an optical scanning unit (200 of FIG. 1) is incident on the photoconductive drum 1, in order to expose the photoconductive drum 1 between the first and second barrier walls 94 and 95.

A waste toner transporting member 60 is installed at the waste toner storage area 11. The waste toner transporting member 60 is connected to an eccentricity portion 71 that is disposed eccentrically from a rotation center of a rotation member 70. As the rotation member 70 rotates, the waste toner transporting member 60 makes a reciprocating motion and transports the waste toner that is removed from the photoconductive drum 1 into the waste toner storage area 11. According to one embodiment, the waste toner transporting member may include an end portion 64 adjacent to the cleaning blade 6 to receive the waste toner from the cleaning blade 6 and to transfer the waste toner to the waste toner storage area 11.

Referring to FIG. 1, the developing device 100 is mounted into a main body 700 of the electrophotographic image forming apparatus through a door 701. The optical scanning unit 200 scans light modulated according to image information onto the photoconductive drum 1 that has been charged to a uniform potential. For example, a laser scanning unit (LSU) that scans light emitted from a laser diode onto the photoconductive drum 1 by deflecting the light in a main scanning direction by using a polygon mirror may be used as the optical scanning unit 200.

The transfer roller 300, which is an example of a transfer unit, is located to face the surface of the photoconductive drum 1, and forms a transfer nip. A transfer bias voltage is applied to the transfer roller 300 so as to transfer a toner image developed on the surface of the photoconductive drum 1 to the recording medium P.

A corona transfer unit may be used instead of the transfer roller 300. The toner image transferred to the surface of the recording medium P by the transfer roller 300 remains adhered to the surface of the recording medium P due to electrostatic attraction. The fixing unit or fusing unit 400 applies heat and pressure to fix the toner image to the recording medium P, thereby forming a permanent printed image on the recording medium P.

A method of forming an image using the electrophotographic image forming apparatus having the above configuration will now be briefly described. When a charging bias voltage is applied to the charging roller 2, the photoconductive drum 1 is charged to a uniform potential. The optical scanning unit 200 scans light modulated according to image information onto the photoconductive drum 1 through the optical path 12 formed on the developing device 100, thereby forming an electrostatic latent image on the surface of the photoconductive drum 1. The toner is transported to the supply roller 4 via the agitator 7, and the supply roller 4 attaches the toner to the surface of the developing roller 3. The regulator 5 forms a toner layer having a uniform thickness on the surface of the developing roller 3. A developing bias voltage is applied to the developing roller 3. The toner that is moved to the development nip D as the developing roller 3 rotates is transferred and attached to the electrostatic latent image, which is formed on the surface of the photoconductive drum 1, due to the developing bias voltage, so that a visible toner image is formed on the surface of the photoconductive drum 1. The recording medium P picked up from a recording medium tray 501 by a pick-up roller 502 is transported to the transfer nip between the transfer roller 300 and the photoconductive drum 1 by a transporting roller 503. When a transfer bias voltage is applied to the transfer roller 300, the toner image formed on the photosensitive drum 1 is transferred to the recording medium P by electrostatic attraction. The toner image transferred to the recording medium P is fixed to the recording medium P by heat and pressure applied from the fixing unit 400, and thus, the printing is completed. The recording medium P is discharged to the outside by a discharge roller 504. Toner remaining on the surface of the photoconductive drum 1 without being transferred to the recording medium P is removed by a cleaning member 6 and collected in a waste toner storage area 11.

The developing device 100 is replaceable, and thus may be handled separately from the main body 700 of the electrophotographic image forming apparatus. A developing portion 13 in which the developing roller 3 is installed is connected to the toner storage area 10 via a toner supply window 8. When the toner storage area 10 and the developing portion 13 are connected to each other, the toner may leak through the opening 93 during a distribution or handling process. Thus, as illustrated in FIG. 2, the toner supply window 8 is closed using a blocking member 80 so that the toner storage area 10 and the developing portion 13 may be separated from each other. The blocking member 80 is removed before the developing device 100 is mounted on the main body 700, so that the toner storage area 10 and the developing portion 13 may be connected to each other via the toner supply window 8. Then, the toner contained in the toner storage area 10 may be supplied to the developing portion 13.

In a conventional developing device, a barrier wall member (not shown) to which a blocking film (not shown) is attached is fused on the toner supply window 8, and part of the blocking film is exposed to the outside of the housing 90. In the conventional developing device, the toner storage area 10 and the developing portion 13 are connected to each other by removing the blocking film by pulling out the exposed part of the blocking film. Thus, in the conventional developing device, a process of attaching the blocking film to the barrier wall member and a process of fusing the barrier wall member on the inside of the housing 90 need to be performed, and thus the manufacturing costs increase. In addition, since the toner storage area 10 and the developing portion 13 are completely separated from each other, toner for a performance test of the developing device needs to be loaded into the developing portion 13 so as to carry out the performance test of the developing device. To this end, a loading hole (not shown) through which the toner for the performance test is loaded into the developing portion 13 needs to be formed in the housing 90, and after the performance test is completed, a process of closing or sealing the loading hole needs to be performed.

Figure 3:
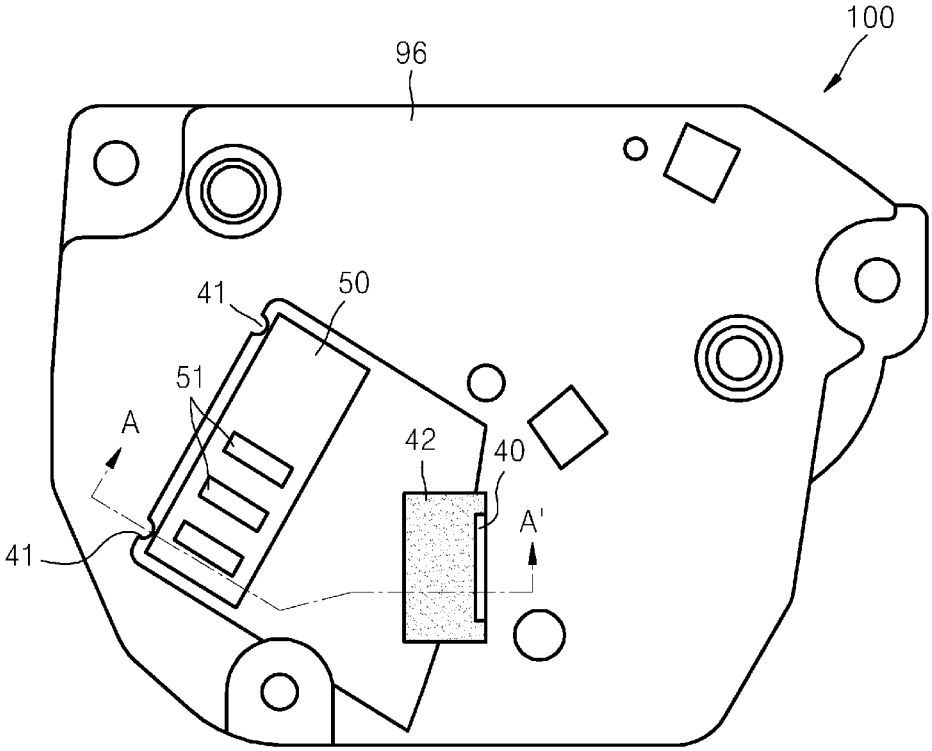
FIG. 3 is a side view of the developing device illustrated in FIG. 2, according to an embodiment of the present general inventive concept.
Figure 4:
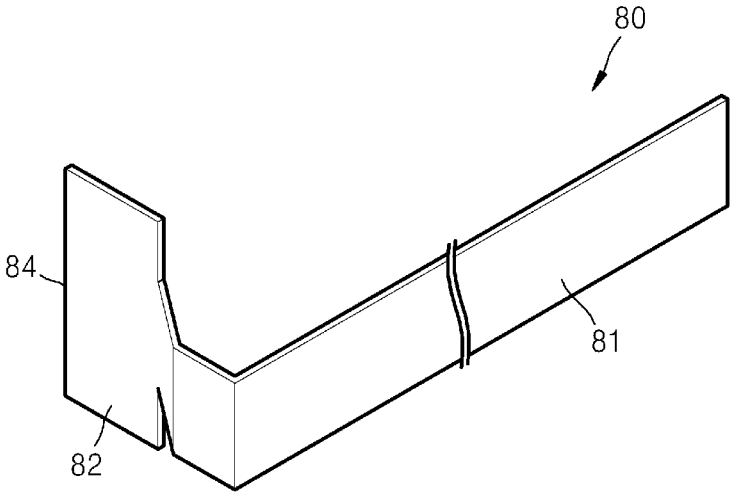
FIG. 4 is a perspective view of a blocking member, according to an embodiment of the present general inventive concept.

In the developing device 100 according to the present general inventive concept, the blocking member 80 is inserted in the inside of the housing 90 from the outside of the housing 90, thereby closing the toner supply window 8. Referring to FIG. 2, a pair of rails 9 are disposed on the toner supply window 8 and extend in a lengthwise direction of the developing roller 3, or along the length axis F illustrated in FIG. 7. The rails 9 extend along upper and lower edges of the toner supply window 8. The rails 9 include a groove recessed between two raised portions, and the ends of the blocking portion 81 can slide in the lengthwise directions F1 and F2 along the groove to block the toner supply window 8. Referring to FIG. 3, an insertion hole 40 is formed in sidewalls (96 of FIG. 3) of the housing 90 to be aligned with the rails 9. Referring to FIG. 4, the blocking member 80 includes a blocking portion 81 that is inserted in the rails 9 and closes the toner supply window 8, and a bent portion 82 that is bent from the blocking portion 81. The bent portion 82 is disposed at the outside of the housing 90 while the blocking portion 81 is inserted in the rails 9. The bent portion 82 may serve as a handle when the blocking portion 81 is removed from the rails 9.

Figure 5:
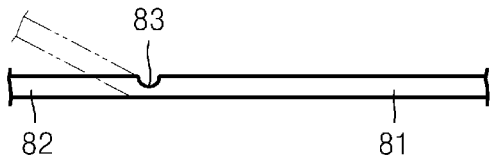
FIG. 5 is a side view of a blocking member in which a bending line is formed, according to an embodiment of the present general inventive concept.

The blocking member 80 may be manufactured by cutting a flexible board that may be elastically bent in a desired form. After the board is cut in the desired form, the bent portion 82 may be bent parallel to sidewalls 96 of the housing 90, as illustrated in FIG. 4. In addition, after the board is cut in the desired form, a bending line 83 may be formed so that the bent portion 82 may be bent with respect to the blocking portion 81 along the bending line 83, as illustrated in FIG. 5. The bending line 83 may be formed to be recessed from the surface of the blocking member 80, for example. In this case, after the blocking portion 81 is inserted in the rails 9, the bent portion 82 may be bent parallel to the sidewall 96 of the housing 90 along the bending line 83. Manufacturing of the blocking member 80 is not limited to the above-described method, and the blocking member 80 may be manufactured using various methods including plastic injection molding or the like.

Figure 6A:
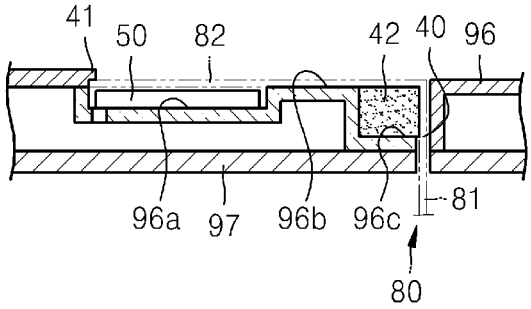
FIGS. 6A, 6B, and 6C are cross-sectional views taken along line A-A' of FIG. 4, according to an embodiment of the present general inventive concept.

Referring to FIGS. 3 and 6A, a securing portion 41 is disposed on the sidewall 96. The securing portion 41 secures the bent portion 82 on the sidewalls 96 while the blocking portion 81 is inserted in the rails 9 and the bent portion 82 is bent in a direction parallel to the sidewall 96. The securing portion 41 may be in the form of a protrusion so that the securing portion 41 may be caught in edges 84 of the bent portion 82.

A communication portion 50 that is electrically connected to the main body 700 after the developing device 100 was mounted on the main body 700 of the electrophotographic image forming apparatus and transmits information about the developing device 100 to the main body 700 may be disposed on the sidewall 96 of the housing 90. For example, the communication portion 50 may be a circuit board including a memory (not shown) in which information such as a model name or the like of the developing device 100 is recorded, and a plurality of electrical contact point portions 51 for electrically connecting the communication portion 50 to the main body 700.

The sidewall 96 may include a first recessed portion 96*a*, and the communication portion 50 may be located within the first recessed portion 96*a*. The sidewall 96 may include a raised portion 96*b* and a second recessed portion 96*c* located between the raised portion 96*b* and the insertion hole 40. The bent portion 82 of the blocking member 80 may be bent to be parallel with each of the recessed portions 96*a* and 96*c* and the raised portion 96*b*. The bent portion 82 may be bent such that a surface of the bent portion 82 directly contacts the raised portion 96*b*. Although the raised portion 96*b* may be raised with respect to the recessed portions 96*a* and 96*c*, the raised portion 96*b* may be recessed with respect to an upper surface of the sidewall 96, such that when the bent portion 82 of the blocking member 80 is bent, an end of the bent portion 82 may be positioned between the securing portion 41 and the recessed portion 96*a* while staying parallel to the recessed portion 96*a*.

The recessed portion 96*c* may be of a sufficient size to receive the sealing member 42. In other words, an upper surface of the sealing member 42 may be flush with an upper surface of the raised portion 96*b* of the sidewall 96.

In the developing device 100 according to the present general inventive concept, the bent portion 82 may also serve as a protection portion that covers and protects the communication portion 50. In detail, as illustrated in FIG. 6, the bent portion 82 may cover an upper portion of the communication portion 50 while being bent parallel to the sidewalls 96 of the housing 90. The securing portion 41 may secure the bent portion 82 on the sidewalls 96 when the bent portion 82 covers the communication portion 50 so that a predetermined force is required to remove the blocking member 80 from the developing unit 100. For example, the securing portion 41 may be designed to overlap the edge 84 of the bent portion 82 sufficiently so that a small shaking force or a gravity force are not sufficient to remove the blocking member 80 from the developer 100, but an intentional force may be required.

The developing device 100 according to the present general inventive concept may further include a sealing member 42 that prevents leakage of the toner via the insertion hole 40. The sealing member 42 may be an elastic member such as a sponge or the like. The sealing member 42 may be attached to the sidewalls 96 of the housing 90 by using a double-sided tape so as to cover at least part of the insertion hole 40. The blocking member 80 may be inserted in the housing 90 via the insertion hole 40 while pushing the sealing member 42.

Figure 6B:
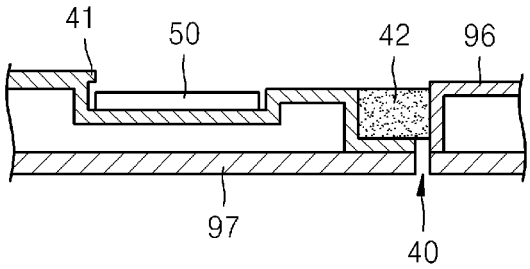

As illustrated in FIG. 6A, when the blocking member 80 is inserted into the insertion hole 40, the toner leakage prevention member 42 presses against the blocking member 80 to prevent any leakage of toner. As illustrated in FIG. 6B, when the blocking member 80 is removed from the insertion hole 40, the elastic nature of the toner leakage prevention member 42 causes the toner leakage prevention member 42 to expand to cover the insertion hole 40 to prevent toner from leaking from the insertion hole 40.

Figure 6C:
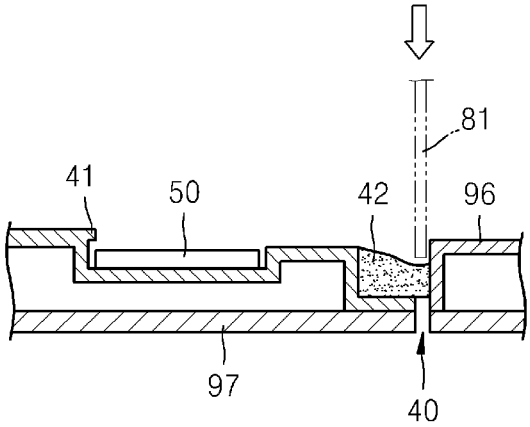

As illustrated in FIG. 6C, the sealing member 42 may have a curved or slanted shape at an end where the blocking member 80 enters the insertion hole 40 to facilitate the entry of the blocking member 80 into the insertion hole 40. Since the blocking member 80 may be repeatedly inserted into and removed from the insertion hole 40, as necessary, the curved end of the sealing member 42 may allow for easier insertion of the blocking member 80 into the insertion hole 40 while providing protection from leaking toner from the hole 40.

The developing device 100 may further include inner sidewalls 97, and the sidewalls 96 may be combined with the inner sidewalls 97. In this case, the insertion hole 40 is formed through the sidewalls 96 and the inner sidewalls 97. The sidewalls 96 may be a support plate that supports the developing roller 3, the charging roller 2 or the like, which is installed at the developing device 100.

Figure 7:
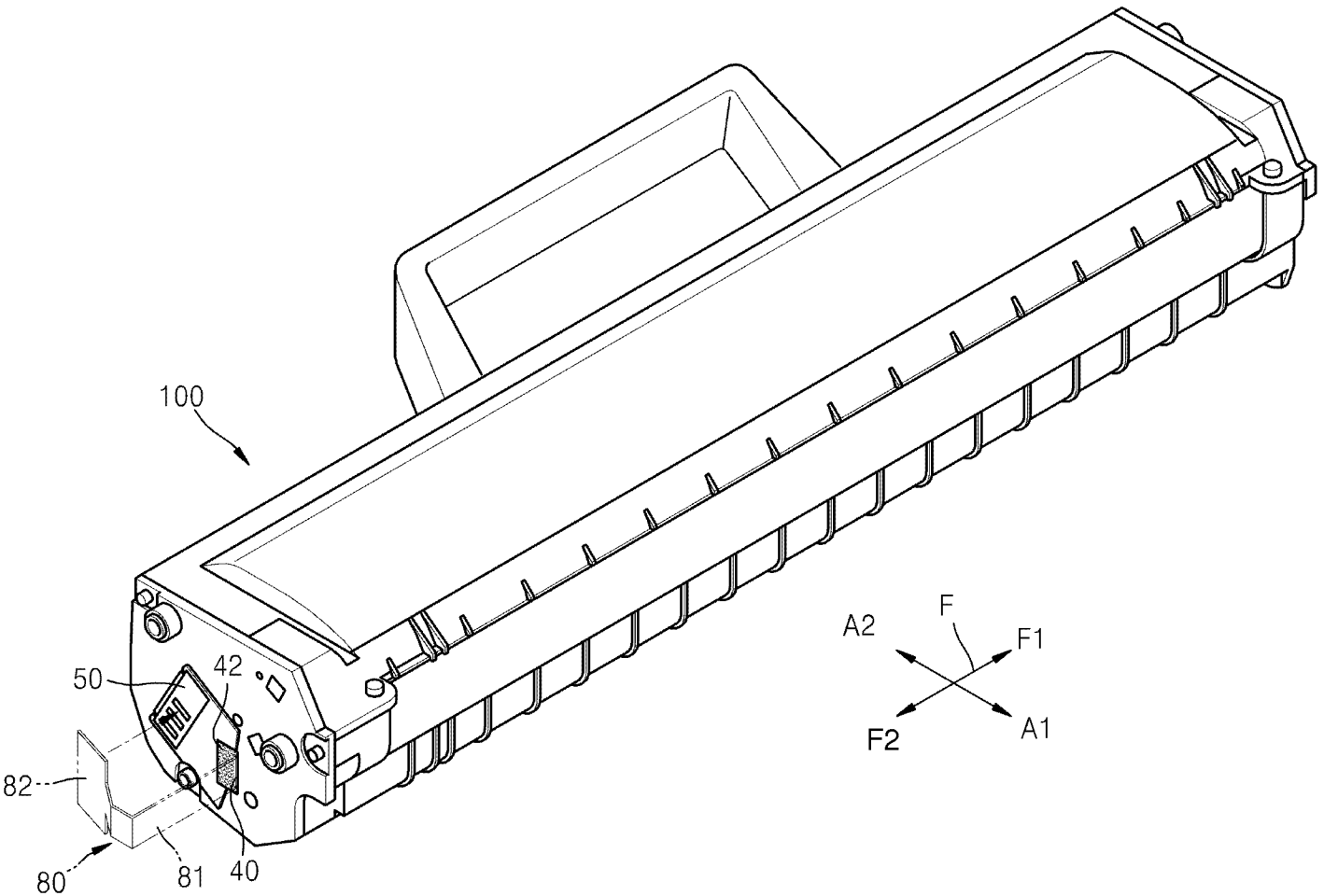
FIG. 7 is a perspective view of the blocking member inserted in a housing via an insertion hole formed in sidewalls of a housing, according to an embodiment of the present general inventive concept.
Figure 8:
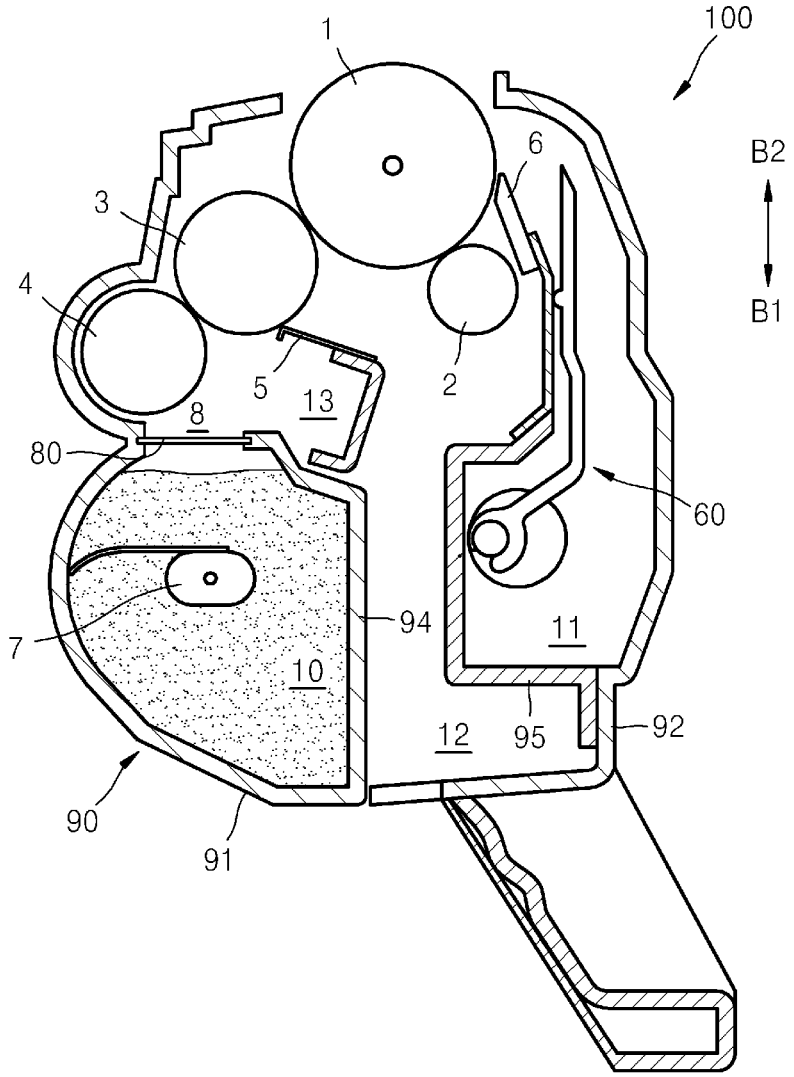
FIG. 8 is a cross-sectional view of the developing device in an upright position in order to recover toner from a developing portion to a toner storage area after a performance test is performed, according to an embodiment of the present general inventive concept.

The toner is charged in the toner storage area 10 while the blocking member 80 is not installed at the developing device 100 after the developing device 100 has been manufactured. Then, as illustrated in FIG. 2, the toner storage area 10 is connected to the developing portion 13 via the toner supply window 8. The performance test of the developing device 100 is performed in this state. When the performance test is completed, as illustrated in FIG. 7, the blocking member 80 is inserted in the rails 9 through the insertion hole 40. In this case, the toner does not need to remain on the developing portion 13. To this end, as illustrated in FIG. 8, the blocking member 80 may be inserted in the rails 9 while the developing portion 13 is oriented upwards and the toner contained in the developing portion 13 is recovered to the toner storage area 10. In other words, if the direction B1 corresponds to the ground and the direction B2 is opposite B1, then the developer may be oriented such that the opening 93 faces the direction B2 and the toner storage area 10 is oriented in the direction B1 with respect to the opening 93.

Figure 9:
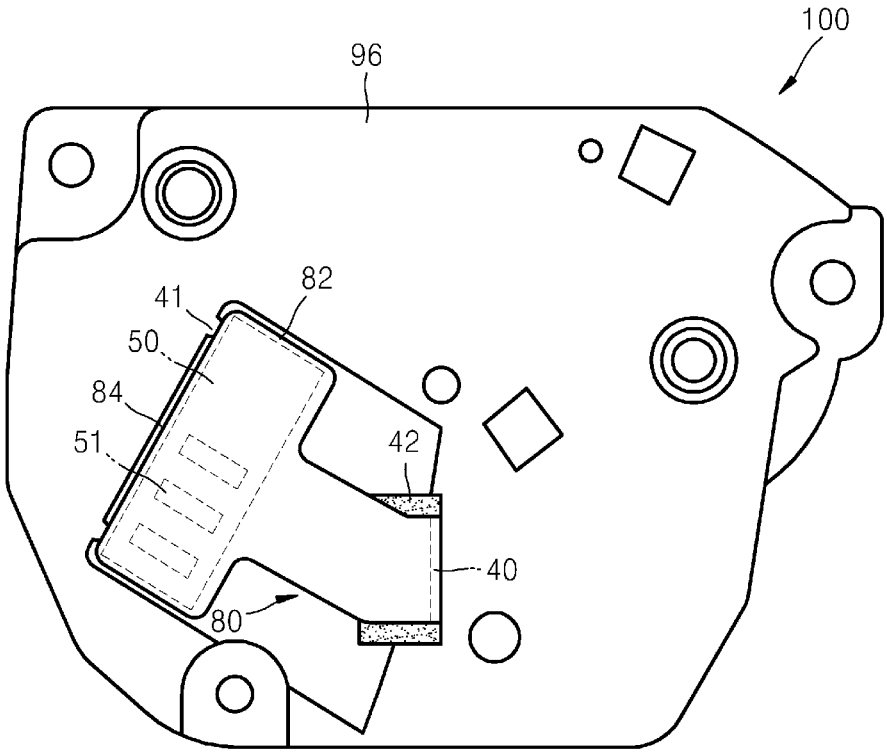
FIG. 9 is a side view of the developing device in which a bent portion of the blocking member covers a communication portion, according to an embodiment of the present general inventive concept.

When the blocking portion 81 is completely inserted in the rails 9, the toner supply window 8 is closed so that the toner storage area 10 and the developing portion 13 may be isolated from each other. As illustrated in FIG. 6A, the bent portion 82 is disposed parallel to the sidewalls 96 of the housing 90, and the edges 84 of the bent portion 82 are caught in the securing portion 41, thereby securing the bent portion 82 on the sidewalls 96. Then, as illustrated in FIG. 9, the bent portion 82 is secured on the sidewalls 96 while covering the communication portion 50, thereby preventing damage of the communication portion 50 due to physical or electrical shock during the distribution process.

The bent portion 82 is released from the securing portion 41 before the developing device 100 is mounted on the main body 700 of the electrophotographic image forming apparatus, and the bent portion 82 is grasped and pulled out in an opposite direction to a direction in which the bent portion 82 is inserted, and the blocking member 80 is removed from the housing 90. Then, the toner storage area 10 and the developing portion 13 are connected to each other via the toner supply window 8. Next, when the developing device 100 is mounted on the main body 700 of the electrophotographic image forming apparatus, the communication portion 50 may be electrically connected to the main body 700 and may transmit information about the developing device 100 to the main body 700.

Figure 10A:
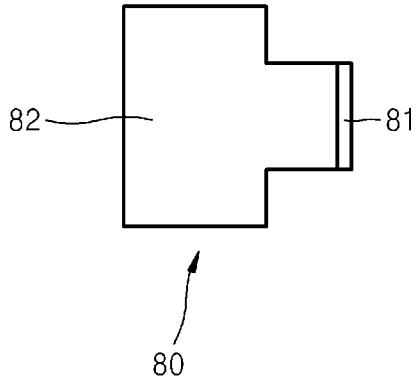
FIGS. 10A-10C illustrate shapes of blocking members according to embodiments of the present general inventive concept.
Figure 10B:
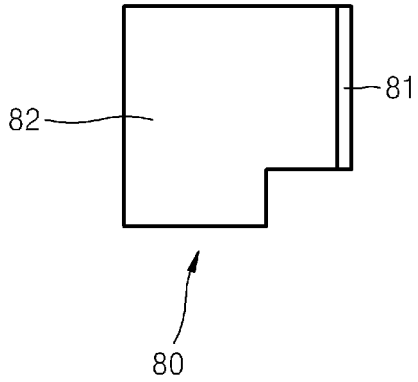
Figure 10C:
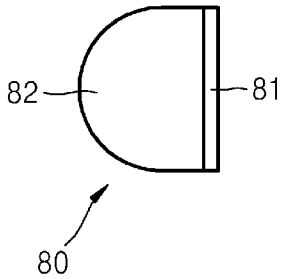

As illustrated in FIGS. 10A-10C, the blocking member 80 may have any shape appropriate to a particular developing unit 100. In FIG. 10A, the bent portion 82 is located at an angle perpendicular to the blocking portion 81. However, the bent portion 82 may be positioned at any angle with respect to the blocking portion 81. For example, as illustrated in FIG. 9, the blocking portion 81 may be rotated at a non-right angle with respect to the blocking portion 81. Alternatively, the blocking portion 81 may be bent at the bending line 83 to an angle less than or more than ninety degrees according to the particular developing unit.

FIG. 10B illustrates a bent portion 82 that has a tab that extends in only one direction (downward). However, the bent portion 82 may have any number of tabs of any shapes. For example, as illustrated in FIG. 10C, the bent portion 82 may be curved or rounded.

The communication portion 50 is covered by the bent portion 82 when the blocking member 80 is inserted into the insertion hole 40 and is exposed when the blocking member 80 is removed from the insertion hole 40. In addition, when the blocking member 80 is inserted into the insertion hole 40, the blocking member 80 may be substantially straight, and the bent portion 82 may then be bent to cover the communication portion 50. In other words, the bent portion 82 may be bent either before or after the blocking portion 80 is inserted into the insertion hole 40.

When the blocking member 80 is removed from the insertion hole 40, the blocking portion 81 no longer closes the toner supply window 8 so that toner may flow between the toner storage area 10 and the developing portion 13, and the bent portion 82 no longer covers the communication portion 50 so that electrical contact points 51 may contact electrical contact points (not shown) of the main body 700 to allow the developing unit 100 to communicate with the main unit 700.

Although a monochromic electrophotographic image forming apparatus including one developing device 100 has been illustrated in the previous embodiments, the scope of the present general inventive concept is not limited thereto. In the case of a color electrophotographic image forming apparatus, four developing devices 100 in which toners having colors such as cyan (C), magenta (M), yellow (Y), and black (K) are contained, may be employed.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developing device to be attached to and detached from a main body of an electrophotographic image forming apparatus, the developing device comprising:

a housing that defines a toner storage area to store toner and a developing portion having a developing roller, the housing includes an opening that defines a toner supply window to connect the toner storage area to the developing portion, a pair of rails disposed adjacent to the toner supply window and extending in an end-to-end lengthwise direction of the developing roller, an insertion hole on an outer surface of the housing corresponding to a location of the pair of rails, and a securing portion formed on an outer surface thereof; and a blocking member including a blocking portion configured such that the toner supply window is open when the blocking member is removed from the pair of rails and the toner supply window is closed when the blocking member is inserted in the pair of rails from an outside of the housing, the blocking member including a bent portion extending from the blocking portion and configured to be removably secured in the securing portion of the housing.

2. The developing device of claim 1, wherein the bent portion is disposed outside of the housing when the blocking portion is inserted in the rails.

3. The developing device of claim 2, wherein the bent portion is bent in a direction parallel to sidewalls of the housing.

4. The developing device of claim 3, further comprising a communication portion disposed on the sidewalls of the housing to electrically connect to the main body when the developing device is mounted on the main body, wherein the bent portion covers the communication portion when the blocking portion is inserted in the rails.

5. The developing device of claim 4, wherein the securing portion is disposed on the sidewalls of the housing to secure the bent portion when the bent portion covers the communication portion.

6. The developing device of claim 2, wherein the bent portion is divided from the blocking portion along a bending line and is bendable in the direction parallel to the sidewalls of the housing.

7. The developing device of claim 6, further comprising a communication portion disposed on the sidewalls of the housing to electrically connect to the main body when the developing device is mounted on the main body, wherein the bent portion is bent parallel to the sidewalls of the housing along the bending line and covers the communication portion when the blocking portion is inserted in the rails.

8. The developing device of claim 1, further comprising a sealing member disposed on sidewalls of the housing and formed of an elastic material to cover the insertion hole.

9. An electrophotographic image forming apparatus comprising the developing device of claim 1.

10. A developing device to be attached to or detached from a main body of an electrophotographic image forming apparatus, the developing device comprising:

a housing defining a toner storage area to store toner, and a developing portion including a developing roller, the housing comprising a toner supply window to connect the toner storage area to the developing portion and a securing portion formed on an outer surface thereof;

a communication portion disposed on sidewalls of the housing to electrically connect to the main body when the developing device is mounted on the main body; and a blocking member that is insertable and removable from the housing and comprising a blocking portion to close the toner supply window and a protection portion to cover the communication portion, the protection portion extending from the blocking portion and configured to be removably secured to the securing portion of the housing.

11. The developing device of claim 10, wherein the blocking portion is inserted into the housing to close the toner supply window from outside of the housing.

12. The developing device of claim 11, further comprising:

a pair of rails located at sides of the toner supply window and extending in a lengthwise direction of the developing roller;

an insertion hole formed in a sidewall of the housing to be aligned with the pair of rails, wherein the blocking portion closes and opens, respectively, the toner supply window when the blocking member is inserted in the pair of rails from the outside of the housing or is removed from the pair of rails via the insertion hole.

13. The developing device of claim 12, further comprising a sealing member disposed on a sidewall of the housing and formed of an elastic material to cover the insertion hole.

14. The developing device of claim 10, wherein the protection portion is bent in a direction parallel to a sidewall of the housing from the blocking portion so as to cover the communication portion.

15. The developing device of claim 14, wherein the securing portion is disposed on a sidewall of the housing to secure the bent portion when the protection portion covers the communication portion.

16. The developing device of claim 10, wherein the protection portion is divided from the blocking portion along a bending line and is bent in the direction that is parallel to a sidewall of the housing along the bending line and covers the communication portion.

17. An electrophotographic image forming apparatus comprising the developing device of claim 10.

18. A developing device, comprising:

a housing that defines a toner storage area to store toner, and a developer area including a developing roller to transmit developer, the housing having an opening that defines a window between the toner storage area and the developer area; and a blocking member including a blocking portion to be secured to a first securing portion of the housing at a side of the window to close the opening, and a bent portion, wherein the blocking member is inserted into the first securing portion from outside a sidewall of the housing to close the window and removed from the first securing portion from outside a sidewall of the housing to open the window, and the bent portion extends from the blocking portion and is configured to be removably secured in a second securing portion formed on an outer surface of the housing.

19. The developing device according to claim 18, wherein the sidewall includes an opening that defines an insertion hole into which the blocking member is inserted to close the window and from which the blocking member is removed to open the window.

20. The developing device according to claim 19, further comprising a sealing member to seal the insertion hole when the blocking member is removed from the insertion hole.

21. The developing device according to claim 20, wherein the sealing member is elastic, such that the sealing member presses against the blocking member when the blocking member is inserted into the insertion hole and seals the insertion hole when the blocking member is removed from the insertion hole.

22. The developing device according to claim 20, wherein the sidewall includes a recess adjacent to the insertion hole, and the sealing member is located within the recess.

23. The developing device according to claim 20, wherein at least one side of the sealing member adjacent to the insertion hole is slanted with respect to a portion of the sealing member in contact with the sidewall.

24. The developing device according to claim 18, wherein the first securing portion includes at least one rail that extends in an end-to-end lengthwise direction of the developing roller to guide the blocking member across the opening that defines the window.

25. The developing device according to claim 18, wherein the bent portion is located adjacent to and parallel to the sidewall when the blocking portion is inserted into the first securing portion.

26. The developing device according to claim 25, further comprising electrical connections on a surface of the sidewall, wherein the bent portion covers the electrical connections when the blocking portion is inserted into the first securing portion, and the bent portion does not cover the electrical connections when the blocking portion is removed from the first securing portion.

27. The developing device according to claim 25, wherein the sidewall includes the at least one second securing portion to secure the bent portion to the sidewall.

28. The developing device according to claim 27, wherein the second securing portion is a tab that extends from the sidewall to cover at least a portion of the bent portion when the blocking portion is inserted into the first securing portion.

29. The developing device according to claim 25, wherein the blocking member includes a bending line to bend the blocking member such that the bent portion is at an angle with respect to the blocking portion.

30. The developing device according to claim 29, wherein the bending line is a recess formed in the blocking member.

31. The developing device according to claim 18, wherein the blocking member and the bent portion are configured to be repeatedly inserted into, and removed from, the first securing portion and the second securing portion, respectively.

32. An image forming apparatus, comprising:

a developing unit; and an optical scanning unit to scan light onto a photoconductive unit of the developing unit to form an image on the photoconductive unit, wherein the developing unit comprises:

a housing that defines a toner storage area to store toner, and a developer area including a developing roller to transmit developer, the housing having an opening that defines a window between the toner storage area and the developer area; and a blocking member to be secured to a first securing portion of the housing at a side of the window to close the opening, and wherein the blocking member is inserted into the first securing portion and removed from the first securing portion from outside a sidewall of the housing and includes a bent portion extending outside of the housing when the blocking member is inserted into the first securing portion, and configured to be removably secured in a second securing portion formed on an outer surface of the housing.

33. A developing device usable with an image forming apparatus, comprising:

a housing having a toner storage area and a developer area, and a window located between the toner storage area and the developer area;

a communication portion located on an outside of the housing to electrically connect to a communication device of the image forming apparatus; and a blocking member having a blocking portion to block the window, which is insertable and removable from the housing, and a bent portion that extends from the blocking portion to cover the communication portion, the bent portion extending from the blocking portion and configured to be removably secured to a securing portion formed on an outer surface of the housing.

34. The developing device according to claim 33, wherein the blocking member is removed from the housing to connect the toner storage area and the developer area and to expose the communication portion.

35. The developing device according to claim 33, wherein the housing comprises a hole formed therein to communicate with the window, and a rail extending the length of the window to guide the blocking member across the window.

36. The developing device according to claim 33, wherein the blocking member includes a middle portion between the blocking portion and the bent portion, and the thickness of the middle portion is less than the thicknesses of each of the blocking portion and the bent portion.

37. The developing device according to claim 33, wherein the housing comprises:

a hole formed therein to accommodate the blocking member;

a first recess to accommodate the communication portion;

a second recess adjacent to the hole; and a raised portion located between the first and second recesses.

38. The developing device according to claim 37, further comprising a sealing member, wherein the sealing member is located in the second recess to seal the hole when the blocking member is not located in the hole.

39. The developing device according to claim 33, wherein the housing comprises a hole in an outer surface thereof to accommodate the blocking portion of the blocking member, wherein the communication portion is located within a distance of the hole corresponding to a length of the bent portion.

40. A method of controlling a flow of toner between a toner storage area and a developer area of a developer housing the method comprising:

inserting a first portion of a blocking member into a hole in the developer housing to block a window connecting the toner storage area to the developer area and a second portion of the blocking member into a securing portion formed on an outer surface of the developer housing to secure the second portion, the second portion extending from the first portion; and removing the first and second portions of the blocking member from the hole and securing portion in the developer housing, respectively, to open the window and to allow the flow of toner between the toner storage area and the developer area.

41. The method according to claim 40, wherein inserting and removing the blocking member includes sliding the blocking member along a rail within the developer housing.

42. The method according to claim 40, further comprising repeatedly reinserting, and repeatedly removing, the first and second portions of the blocking member into, and from, the hole and the securing portion, respectively.

* * * * *